US007845973B2

(12) United States Patent
Iida et al.

(10) Patent No.: US 7,845,973 B2
(45) Date of Patent: Dec. 7, 2010

(54) CONTACT CONFIGURATION TO BE USED IN A CONNECTOR

(75) Inventors: Yasunaga Iida, Tokyo (JP); Yuki Nakano, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 12/468,241

(22) Filed: May 19, 2009

(65) Prior Publication Data

US 2009/0298315 A1 Dec. 3, 2009

(30) Foreign Application Priority Data

May 30, 2008 (JP) ..... 2008-141805

(51) Int. Cl.
*H01R 12/24* (2006.01)

(52) U.S. Cl. ..... 439/495

(58) Field of Classification Search ..... 439/259, 439/852, 492–495, 260, 267, 67
See application file for complete search history.

(56) References Cited

U.S. PATENT DOCUMENTS

| | | | | |
|---|---|---|---|---|
| 7,341,470 | B2 * | 3/2008 | Suzuki et al. | 439/260 |
| 2006/0281353 | A1 * | 12/2006 | Suzuki et al. | 439/260 |

FOREIGN PATENT DOCUMENTS

| | | |
|---|---|---|
| JP | 2002-270290 | 9/2002 |
| JP | 2003-17167 | 1/2003 |
| JP | 2007-73296 | 3/2007 |
| JP | 2007-234525 | 9/2007 |
| JP | 2009230942 (A) | 10/2009 |
| JP | 2009266606 (A) | 11/2009 |

* cited by examiner

*Primary Examiner*—Javaid Nasri
(74) *Attorney, Agent, or Firm*—Dickstein Shapiro LLP

(57) ABSTRACT

A contact has at least one contact portion adapted to contact a first connecting object and a connection portion to be connected to a second connecting object. The contact is provided with an protruded contact portion positioned between the contact portion provided at a free end of the contact and the connection portion and curved and substantially aligned with the contact portion. A member having a pushing portion for pushing the first connecting object is so arranged that the pushing portion is in a position facing to the protruded contact portion. With the contacts thus constructed, even if a great number of the contacts are arranged, large forces are not required for inserting and fitting a connecting object in a connector using the contacts, thereby achieving a stable electrical connection. Moreover, the contacts can be arranged with extremely narrow pitches in a connector, and using the contacts, it is possible to construct reduced overall height connectors, and connectors miniaturized particularly in the inserting direction of a connecting object.

2 Claims, 6 Drawing Sheets

CONTACT CONFIGURATION TO BE USED IN A CONNECTOR

BACKGROUND OF THE INVENTION

This invention relates to a contact configuration to be used in a connector, a connector for use with electric and electronic appliances such as factory automation appliances, office automation appliances, cellular or mobile phones, and the like.

In general, hitherto used contacts for connectors each have a contact portion adapted to contact a first connecting object, a fixed portion held in an insulator, and a connection portion to be connected to a second connecting object. The first connection object includes a mating connector, substrate, flexible printed circuit board, flexible flat cable, and the like. The second connecting object includes a substrate, flexible printed circuit board, flexible flat cable, and the like.

As the contact portion adapted to contact the first connecting object is required to stably contact the connecting object, quite frequently, two contact portions are provided one on each side of the inserting direction of the first connecting object. In order to improve the connection stability, there are cases that the number of the contacts is further increased as disclosed in the following parent literatures.

Six patent literatures are shown hereafter, which are Japanese Patent Application Opened No. 2007-73,296 proposed by the applicant of the present case (Patent Literature 1), Japanese Patent Application Opened No. 2002-270,290 (Patent Literature 2), Japanese Patent Application Opened No. 2003-17,167 (Patent Literature 3), Japanese Patent Application No. 2008-72,701 (Japanese Patent Opened No. 2009-230942) proposed by the applicant of the present case (Patent Literature 4), Japanese Patent Application No. 2008-114,696 (Japanese Patent Opened No. 2009-266606) proposed by the applicant (Patent Literature 5), and Japanese Patent Application Opened No. 2007-234,525 (Patent Literature 6).

Patent Literature 1

According to the abstract of the Japanese Patent Application Opened No. 2007-73,296 proposed by the applicant of the present case, the invention has an object to provide an electrical connector for a flexible printed circuit board, which enables contacts to be detachably fitted therein so that even if the contacts are failed, they can be easily replaced with new ones. Disclosed is an electrical connector including contacts 1 each having a junction 4 to be electrically connected to another substrate and a pair of contact portions 5a and 5b bifurcated and extending from the junction 4 to form a bearing space 10 therebetween; an array plate 2 for forming thereon a contact group by aligning a plurality of the contacts 1 in a particular direction (Y direction); and a cam shaft 3 positioned and rotatably held within the bearing spaces 10 of the contacts 1 aligned with one another on the array plate 2 to form a contact group and having a major axis portion 11 and a minor axis portion 12 different in size such that former is larger and the latter is smaller than the width W of the bearing spaces 10 so that the cam shaft 3 is axially insertable into and retractable from the bearing spaces 10 of the contacts 1 forming the contact group.

Incidentally, claim 1 of the Japanese Patent Application Opened No. 2007-73,296 recites an aligned contact group comprising contacts each including a junction to be electrically connected to another substrate and a pair of contact portions bifurcated and extending from said junction and each having at a tip at least one electric contact adapted to be electrically connected to an electrode formed on a surface of an inserted flexible substrate, and an array plate for forming thereon a contact group by substantially aligning a plurality of said contacts in a particular direction, and each of the contacts forming said contact group having a bearing space located between both the contact portions nearer to the junction than do the electric contacts, the bearing space for rotatably positioning and holding therein a cam shaft in the form of bar which is axially insertable into and retractable from the bearing space. Claim 2 recites the aligned contact group as claimed in claim 1, wherein the cam shaft has a major axis portion and a minor axis portion different in size such that the former is larger and the latter is smaller than the width of said bearing spaces. Claim 3 recites the aligned contact group as claimed in claim 1 or 2, wherein said contacts are made of an elastic conductive material, wherein when inserting the flexible substrate into spaces between both the contact portions of the contacts forming said contact group, said cam shaft is rotated within said bearing spaces and said major axis portion of the cam shaft is held in a position where said major axis portion is facing to both the contact portions so that both the contact portions of the contacts forming said contact group are spread by the action of the outer surfaces of the cam shaft so as to widen spacing between said electric contacts of both the contact portions to be wider than the thickness of said flexible substrate, thereby enabling the flexible substrate to be inserted between the electric contacts without requiring any insertion force, and wherein when electrically connecting electrodes of the inserted flexible substrate to the electric contacts of the contacts forming said contact group, said cam shaft is rotated within said bearing spaces to a position where the minor axis portion of said cam shaft is facing to both the contact portions so that both the contact portions of the contacts forming said contact group are elastically restored such that the spacing between the electric contacts of said contact portions becomes smaller than the thickness of said flexible substrate, thereby electrically connecting the electrodes of the flexible substrate and the electric contacts of said respective contacts. Claim 4 recites an electrical connector for the flexible substrate as claimed in any one of claims 1 to 3, wherein said cam shaft is provided at one end with a detachable operating lever for rotating the cam shaft. Claim 5 recites an electrical connector for the flexible substrate as claimed in any one of claims 1 to 4, wherein said contacts are each provided with a projection at the portion defining said bearing space for preventing the cam shaft from moving in longitudinal direction of said contact portion. Claim 6 recites an electrical connector for a flexible substrate comprising contacts each including a junction to be electrically connected to another substrate and a pair of contact portions bifurcated and extending from said junction and each having at a tip at least one electric contact adapted to be electrically connected to an electrode formed on a surface of the inserted flexible substrate, and said contacts each further including a bearing space located between these contact portions nearer to said junction than do said electric contacts, an array plate for forming thereon a contact group by substantially aligning a plurality of said contacts in a particular direction, and a cam shaft in the form of a bar rotatably positioned and held within said bearing spaces of said contacts aligned with one another on said array plate to form a contact group, and having a major axis portion and a minor axis portion different in size such that the former is larger and the latter is smaller than the width of said bearing spaces of both the contact portions, and said cam shaft being axially insertable into and retractable from said bearing spaces of said contacts forming said contact group.

Patent Literature 2

According to the abstract of the Japanese Patent Application Opened No. 2002-270,290, this invention has an object to provide a reduced overall height connector having an actuator which is actuated by a slight operating force and capable of enlarging moving distances of contacts to securely perform electrical connection. Disclosed is a connector comprising an actuator 30 having cam portions 31 and an actuating portion 33, between both the portions being formed with relief grooves 32 into which proximities 14a of tips of spring portions 14 of the contacts 10 are inserted and removed, so that when the actuator is rotated about its fulcrum 31a through 90° in a clockwise direction, the cam portions cause the spring portions and connecting spring portions 13 of the respective contacts to be elastically deformed to embrace a flexible printed circuit board 50 between projections 11a and 11b of the contact portions 11 and projections 12a and 12*b* of the contact portions 12, with the result that patterns of the flexible printed circuit board 50 are connected to a printed substrate 60 through terminals 17 of the respective contacts, and an insulator 20 having a ceiling portion 22 covering the contact portions 11 of the respective contacts and formed in the lower portion of the front side of the ceiling portion with a guide portion 22a for inserting the flexible printed circuit board into the connector.

Incidentally, claim 1 of the Japanese Patent Application Opened No. 2002-270,290 recites a connector including contacts, an insulator holding said contacts, and an actuator rotatably mounted on said insulator and enabling said contacts to be elastically deformed to bring them into contact with a connecting object, wherein said contacts each comprise a first beam having on one side a contact portion adapted to contact said connecting object and on the other side an actuated portion to be actuated by said actuator, a second beam having on one side a contact portion adapted to contact said connecting object and on the other side a terminal portion to be connected to a printed substrate, and a jointing spring portion connecting said first and second beams, and wherein said insulator includes a ceiling portion for covering at least ones of the contact portions from the fitting side and said ceiling portion is formed with a guide portion for guiding the insertion of said connecting object. Claim 2 recites the connector as claimed in claim 1, wherein at least ones of the contact portions are each provided with an inclined portion inclined toward said connecting object in the proximity of said jointing spring portion. Claim 3 recites the connector as claimed in claim 1, wherein said actuator comprises an actuating portion, cam portions for actuating said actuated portions of said contacts, and relief grooves between said actuating portion and said cam portions so that said actuated portions can be inserted into said relief grooves before the connector is connected to said connecting object. Claim 4 recites a connector including contacts, an insulator holding said contacts, and an actuator rotatably mounted on said insulator and enabling said contacts to be elastically deformed to bring them into contact with a connecting object, wherein said contacts each comprise a first beam having on one side a contact portion adapted to contact said connecting object and on the other side an actuated portion to be actuated by said actuator, a second beam having on one side a contact portion adapted to contact said connecting object and on the other side a terminal portion to be connected to a printed substrate, and a jointing spring portion connecting said first and second beams, and wherein the contact portions of said first beams each include a first protrusion and a second protrusion arranged side by side one on each side of the inserting direction of said connecting object and extending toward said connecting object, and the contact portions of said second beams each include a third protrusion and a fourth protrusion arranged side by side one on each side of the inserting direction of said connecting object and extending toward said connecting object so that said third protrusion is positioned between said first protrusion and said second protrusion or said first protrusion is positioned between said third protrusion and said fourth protrusion with the result that said first and second protrusions or said third and fourth protrusions become in contact with said connecting object.

Patent Literature 3

According to the abstract of the Japanese Patent Application Opened No. 2003-17,167, this invention has an object to provide a connector having a pivotal actuator for a flexible printed circuit board or flexible flat cable, having pivotal movement operability and high contact pressure in a balanced manner. Discloses is a connector for a flexible printed circuit board or flexible flat cable, includes a plurality of contacts each having a contact leg adapted to contact the circuit board or flat cable and a stabilizer leg corresponding to the contact leg, said contacts consisting of a front group of contacts each having the contact leg on the front side and a rear group of contacts, and an actuator formed with spring receiving portions and insertion protrusions arranged alternately at every other positions corresponding to the respective stabilizer legs of the rear and front contacts, wherein the stabilizer legs of the rear group of contacts are formed as elastically deforming legs which engage the spring receiving portions of the actuator to be elastically deformed, and the stabilizer legs of the front group of contacts are formed as fixed legs so that when the actuator is pivotally moved into a locked position, its insertion protrusions are inserted between said stabilizer legs and the circuit board or flat cable so as to generate contact pressures between the circuit board or flat cable and the contact legs of both the groups of the contacts.

Incidentally, claim 1 of the Japanese Patent Application Opened No. 2003-17,167 recites a connector for a flexible printed circuit board or flexible flat cable, including an insulator having a plurality of contacts adapted to contact the circuit board or flat cable; and an actuator pivotally actuated between a locking position and an unlocking position relative to the insulator and in the locking position subjected to contact pressures of the elastically deformed contacts and the circuit board or flat cable, wherein said plurality of the contacts each comprise a contact leg adapted to contact the circuit board or flat cable and a stabilizer leg corresponding to the contact leg to form inserting grooves for the circuit board or flat cable, said plurality of contacts consisting of a first group of the contacts and a second group of the contacts arranged in parallel with each other, said first and second groups of the contacts being front group of the contacts and rear group of the contacts alternately aligned at every other position on front and rear sides with respect to the inserting direction of the circuit board, wherein said actuator comprises spring receiving portions and insertion protrusions formed alternately at every other positions corresponding to the respective stabilizer legs of the rear group of the contacts and of the front group of contacts, and wherein when the actuator is pivotally moved between the locking position and the unlocking position, the stabilizer legs of said rear group of the contacts engage said spring receiving portions of the actuator to be elastically deformed so that these stabilizer legs serve as elastically deforming legs, and when the actuator is pivotally moved into the locking position and the insertion protrusions of the actuator are inserted into between said stabilizer legs and the circuit board or flat cable, the stabilizer legs of said front group of the contacts are subjected to forces from the elastically deformed contact legs of both the groups of the contacts to cause contact forces with the circuit board or flat cable so that these stabilizer legs serve as fixed legs. Claim 2 recites the connector for a flexible printed circuit board or flexible flat cable, as claimed in claim 1 wherein the actuator has pushing projections for pushing the circuit board or flat cable when the actuator is pivotally moved from the pivoted end of unlocking toward the locking, and when the pushing projections push the circuit board or flat cable to cause it to be deformed toward the contact legs to the maximal extent, said spring receiving portions cause the elastically deforming legs of the rear group of the contacts to be elastically deformed to the maximal extent and cause the elastically deformed amounts to be reduced before and after the maximal deformation. Claim 3 recites the connector for a flexible printed circuit board or flexible flat cable as claimed in claim 2, wherein the locking position of the actuator is a position where the actuator is substantially parallel to the insulator, and the pivoted end of the unlocking is a position where said actuator crosses over the position where the actuator is perpendicular to the insulator, while the maximal displacement of the elastically deforming legs of said rear group of the contacts occurs in a position where the actuator has been pivoted toward the locking position over the position where the actuator is perpendicular to the insulator to cause the actuator to produce a click pivoting force toward the locking position. Claim 4 recites the connector for a flexible printed circuit board or flexible flat cable as claimed in claim 1, wherein the spring receiving portions of the actuator each comprise a cam portion which causes the actuator to generate a click pivoting force in the locking direction by causing the elastically deforming legs of the rear group of the contacts to be elastically deformed once to the maximal extent at a position where the actuator has been pivoted toward the locking position over the position where the actuator is perpendicular to the insulator when the actuator is pivotally moved from the pivoted end of unlocking into the locking direction, and thereafter by decreasing the elastically deformed amounts.

Patent Literature 4

According to the abstract of the Japanese Patent Application No. 2008-72,701 previously proposed by the applicant of the present case, this invention has an object to provide contacts 20 enabling a stable connection without increasing fitting and inserting forces even if a great number of contacts are used. Disclosed is a contact 20 having contact portions 22 adapted to contact a first connecting object 50 and arranged facing to each other one on each side of the inserting direction of a first connecting object 50, a fixed portion 24 held in an insulator 12, and a connection portion 26 to be connected to a second connecting object 60, the contact 20 comprising at least four independent elastic pieces 28 extending in at least one direction of the inserting direction of the first connecting object 50 and the opposite direction therefrom, and the elastic pieces 28 each provided at a predetermined position with at least one contact portion 22 arranged to embrace the first connecting object 50 by the contact portions 22 facing to each other of the elastic pieces 28.

Incidentally, claim 1 of the Patent Application No. 2008-72,701 recites a contact having contact portions adapted to contact a first connecting object and arranged facing to each other one on each side of the inserting direction of the first connecting object, a fixed portion to be held in an insulator, and a connection portion to be connected to a second connecting object, the contact comprising at least four independent elastic pieces extending in at least one direction of the inserting direction of said first connecting object and opposite direction therefrom, and said elastic pieces each provided at a predetermined position with at least one of said contact portions arranged to embrace said first connecting object by the contact portions facing to each other of the elastic pieces. Claim 2 recites the contact as claimed in claim 1, wherein said elastic pieces are arranged symmetrically with respect to the inserting direction of said first connecting object or in the direction perpendicular to the inserting direction. Claim 3 recites the contact as claimed in claim 1, wherein said elastic pieces are arranged asymmetrically with respect to the inserting direction of said first connecting object or in the direction perpendicular to the inserting direction. Claim 4 recites the contact as claimed in any one of claims 1 to 3, wherein said elastic pieces are each provided at its tip with the contact portion adapted to contact said first connecting object. Claim 5 recites the contact as claimed in any one of claims 2 to 4, wherein the two respective elastic pieces are arranged symmetrically with respect to the inserting direction of said first connecting object, and said elastic pieces are each provided at its tip with the contact portion. Claim 6 recites the contact as claimed in any one of claims 1 to 5, wherein the elastic length of said elastic pieces is 1.0 to 50. Claim 7 recites a connector having the contacts of claims 1 to 6 arranged and held in an insulator.

Patent Literature 5

According to the abstract of the Patent Application No. 2008-114,696, this invention has an object to provide contacts 20 enabling a stable connection without increasing fitting and inserting forces, a reduced overall height and a miniaturization in the inserting direction of a connector even if a great number of the contacts are arranged in the connector. Disclosed is a contact having at least one contact portion 22 adapted to contact a first connecting object, a fixed portion 34 to be held in an insulator 12, and a connection portion 36 to be connected to a second connecting object, wherein the free end of the contact portion is extended to form an extension portion 44 which is folded back in the inserting direction of the first connecting object and further in the direction of the thickness of the first connecting object, and the folded extension portion 44 is provided with at least one new contact portion (second contact portion) 24.

Incidentally, claim 1 of the Japanese Patent Application No. 2008-114,696 recites a contact having at least one contact portion adapted to contact a first connecting object, a fixed portion to be held in an insulator, and a connection portion to be connected to a second connecting object, wherein the free end of said contact portion is extended to form an extension portion which is bent back in the inserting direction of said first connecting object and further in the direction of the thickness of the first connecting object, and the folded extension portion is provided with at least one new contact portion. Claim 2 recites the contact as claimed in claim 1, wherein at least one contact portion is further provided at a position facing to said contact portion and said new contact portion. Claim 3 recites the contact as claimed in claim 2, wherein the free end of the contact portion further provided at the position facing to said contact portion and said new contact portion is extended to form a second extension portion which is bent back in the inserting direction of said first connecting object and further in the direction of the thickness of the first connecting object, and the folded extension portion is also provided with at least one new contact portion. Claim 4 recites the contact as claimed in claim 3, wherein said contact portion is named a first contact portion, and one new contact portion is provided as said at least one new contact portion, which is named a second contact portion, and said first contact portion and said second contact portion are arranged at the same distances from the folded portion, and wherein the contact portion further provided at the position facing to said contact portion and said new contact portion is named a third contact portion and the contact portion provided on said second extension portion is named a fourth contact portion, and said third contact portion and said fourth contact portion are arranged at the same distances or at different distances from the folded portion. Claim 5 recites the contact as claimed in claim 3, wherein said contact portion is named a first contact portion, and one new contact portion is provided as said at least one new contact portion, which is named a second contact portion, and said first contact portion and said second contact portion are arranged at the different distances from the folded portion, and wherein the contact portion further provided at the position facing to said contact portion and said new contact portion is named a third contact portion and the contact portion provided on said second extension portion is named a fourth contact portion, and said third contact portion and said fourth contact portion are arranged at the same distances or at different distances from the folded portion. Claim 6 recites a connector having the contacts claimed in claims 1 to 5 arranged and held in an insulator.

Patent Literature 6

According to the abstract of the Japanese Patent Application Opened No. 2007-234,525, this invention has an object to provide a connector for a circuit board connecting member, and to provide a multilayer printed circuit board and a method for producing a circuit board connecting structure, these enabling a printed circuit board to be securely and detachably connected to the circuit board connecting member and enabling an area and a volume required for connection to be minimal. A flexible circuit board connector 1 comprises a housing 11 made of a molded resin in the form of a U-shape and having an opening 11a, and contact pins 6 arranged at predetermined intervals in the opening 11a of the housing 11. The contact pins 6 are formed from an elastic metal so as to have a bent portion. The housing 11 comprises engaging portions 11b in the proximities of both inner ends in the opening 11a, the engaging portions 11b being formed to be elastically deformable and each having a recess, and loading portions 11c on both outer sides of the engaging portions 11b. There is a predetermined space between the engaging portion 11b and the loading portion 11c so that the engaging portion 11b can be elastically deformed by a given amount toward the loading portion 11c.

Incidentally, claim 1 of the Patent Application Opened No. 2007-234,525 recites a connector for a circuit board connecting member, the connector to be connected to the circuit board connecting member inserted from the outside into a multilayer printed circuit board through an opening and the connector being arranged in inner layers of the multilayer printed circuit board communicating with the outside through the opening, said connector comprising a housing having a connector opening for inserting said circuit board connecting member and having in said connector opening a plurality of connecting pins at predetermined intervals to be connected to the inner layers of said multilayer printed circuit board, and engaging members positioned in said connector opening and adapted to engage and fix said circuit board connecting member in a state that connecting terminals of said circuit board connecting member are connected to said connecting pins, and said housing comprising loading portions to be embraced between the inner layers of said multilayer printed circuit board. Claim 2 recites the connector for a circuit board connecting member as claimed in claim 1, wherein said housing comprises an exposing opening formed so as to communicate with said connector opening and so as to expose inner layers of said multilayer printed circuit board positioned on the other side of said inner layers to be connected to said respective connecting pins. Claim 3 recites the connector for a circuit board connecting member as claimed in claim 1, wherein said connector comprises said two engaging members positioned on both sides of receiving portions for said connecting pins in said connector opening and having recesses or protrusions adapted to engage engaged portions formed on said circuit board connecting member so that said two engaging members engage said engaged portions from the both sides of said circuit board connecting member, and said respective engaging members are elastically deformable outwardly of both sides of said circuit board connecting member in response to connecting and disconnecting of said circuit board connecting member to and from said connector for the circuit board connecting member. Claim 4 recites the connector for a circuit board connecting member as claimed in claim 3, wherein said engaged portions are formed to have recesses or protrusions to be engaged with said engaging members at the inner layers and both edges in horizontal directions when inserted portions of said circuit board connecting member are inserted into the connector for the circuit board connecting member. Claim 5 recites the connector for a circuit board connecting member as claimed in claim 3, wherein said loading portions are formed to be thicker by a predetermined thickness in the laminating direction of said multilayer printed circuit board than the respective engaging members, and said respective engaging members are arranged on the inner side of both the ends of said loading portions with respect to the laminating direction of said multilayer printed circuit board. Claim 6 recites the connector for a circuit board connecting member as claimed in claim 1, wherein there are provided, in said connector opening, engaging members each having a recess or protrusion adapted to engage an engaged portion formed on said circuit board connecting member and being elastically deformable in the direction of said inner layers to be connected to said respective connecting pins in response to connecting and disconnecting of said circuit board connecting member to and from the connector. Claim 7 recites the connector for a circuit board connecting member as claimed in claim 6, wherein said engaged portions are each formed to have a recess or protrusion to engage said engaging member, said recess or protrusion being on the side of said inner layers adapted to be connected to said respective connecting pins of the inserted portions when said circuit board connecting member is inserted into the connector for the circuit board connecting member. Claim 8 recites the connector for a circuit board connecting member as claimed in claim 1, wherein a resin is molded around said housing and said engaging members to form an integral resin molded unit. Claim 9 recites the connector for a circuit board connecting member as claimed in claim 1, wherein said housing is molded from a resin, and said engaging members are made of a metal and embedded in said housing. Claim 10 recites the connector for a circuit board connecting member as claimed in claim 1, wherein the connector is provided with guide members for preventing said circuit board connecting member from contacting contact locations between said respective connecting pins and said inner layers, when said circuit board connecting member is inserted into said connector opening. Claim 11 recites the connector for a circuit board connecting member as claimed in claim 1, wherein said respective connecting pins are elastically deformable toward said inner layers to which said respective connecting pins are connected, in response to the connecting and disconnecting of said circuit board connecting member to and from the connector for the circuit board connecting member. Claim 12 recites the connector for a circuit board connecting member as claimed in claim 11, wherein said respective connecting pins each comprises a plurality of linear portions formed substantially in parallel with the inserting direction of said circuit board connecting member, a plurality of semicircular arc portions formed in the form of a semicircular arc whose both ends are connected to ends of said linear portions and whose apexes are positioned in substantially perpendicular to said inner layers to which said respective connecting pins are connected, said semicircular arc portions each comprising a first semicircular arc portion adapted to abut against said circuit board connecting member when said circuit board connecting member is inserted into said opening, and a second semicircular arc portion which is a predetermined size smaller than said first semicircular arc portion, and at least said linear portion positioned nearest to said connector opening is connected to said inner layers. Claim 13 recites the connector for a circuit board connecting member as claimed in claim 1, wherein said circuit board connecting member is a flexible circuit board. Claim 14 recites the connector for a circuit board connecting member as claimed in claim 1, wherein said circuit board connecting member is a wire harness formed by binding up a plurality of cables. Claim 15 recites a multilayer printed circuit board having inner layers communicating with the external through an opening and having a connector for a circuit board connecting member arranged in said inner layers and to be connected to the circuit board connecting member inserted from the external through said opening, wherein said connector for the circuit board connecting member comprises a housing having the connector opening into which said circuit board connecting member is inserted, a plurality of connecting pins being received in said connector opening at predetermined intervals and being connected to said inner layers of said multilayer printed circuit board, said housing having loading portions embraced between the inner layers of said multilayer printed circuit board, and said connector further comprises engaging members located in said connector opening and adapted to engage and fix said circuit board connecting member under a condition that connecting terminals of said circuit board connecting member are connected to said connecting pins. Claim 16 recites the multilayer printed circuit board as claimed in claim 15, wherein said housing comprises an exposing opening formed to be in communication with said connector opening and serving to expose inner layers located on the other side of said inner layers of said multilayer printed circuit board being connected to said respective connecting pins, and said circuit board connecting member inserted in said connector opening is held by said respective connecting pins and said inner layers exposed by said exposing opening. Claim 17 recites a method for producing a circuit board connecting structure formed by connecting a circuit board connecting member and a connector for the circuit board connecting member, said connector for the circuit board connecting member being inserted into inner layers of a multilayer printed circuit board, said inner layers communicating with the external through an opening, and said circuit board connecting member being inserted through said opening from the external, said method comprising steps of bonding a reinforcing plate to an end of a conductor assembly consisting of a plurality of wire conductors, and punching the end of said reinforcing plate and said conductor assembly bonded thereto by the use of image-recognition technique to form inserted portions to be inserted into said circuit board connecting member having engaged portions adapted to be engaged with engaging members of said connector for a circuit board connecting member, thereby producing said circuit board connecting member.

The contact having the two contact portions one on each side of the inserting direction of the first connecting object as is the case of the prior art can securely improve the contact reliability. In this case, however, the inserting force for the first connecting object would become great, and particularly the fitting force would become great in the event of a great number of contacts.

With the contact provided with three contact portions as disclosed in the Patent Literature 1 proposed by the applicant of the present case, the contact portion on the rear side, on which two connection portions are arranged, has to be higher than the contact portion on the front side so that the inserting force would become greater and there would be a risk of the connecting object being deformed.

With the case of the low inserting force type connector as disclosed in the Patent Literature 2, the inserting force would become greater and there would be a risk of the connecting object being deformed in the similar way. While, with the zero insertion force type connector, there would be the tendency for irregularities in contact pressure to occur at respective contacts.

In the Patent Literature 3, although it looks like that the independent elastic piece is provided at its tips with (upper and lower) contact portions, the upper protrusion 40d is adapted to engage the actuator 20 but not adapted to contact the mating object. In the construction of the Patent Literature 3, if the upper protrusion 40d is used as a contact portion adapted to contact the mating object, a stable connection could not be obtained.

In order to solve the problems in the Patent Literatures 1 to 3, the applicant of the present case has proposed the Patent Literature 4. However, it does not comply with the requirement for reduced overall height of a connector, although it has the luxury of a longitudinal length. Moreover, it is difficult to achieve the miniaturization of the connector in the inserting direction of the connecting object, because the length of the elastic pieces more than a certain extent is required in order to obtain a stable electrical connection.

Further, the applicant of the present case has proposed that as disclosed in the Patent Literature 5 in order to comply with the requirement for a reduced overall height of connector having the luxury of a longitudinal length. However, the connector disclosed in the Patent Literature 5 has a long longitudinal length, which does not achieve an arrangement of contacts with very narrow pitches.

With the contacts disclosed in the Patent Literature 6 (FIGS. 17 and 18), they are supported at both the ends so that a greater fitting force is required than those in the examples of the prior art and in the Patent Literatures 1 to 3.

SUMMARY OF THE INVENTION

The invention has been completed in view of the problems of the prior art, and the invention has an object to provide a contact to be used in a connector which enables stable electrical connection without requiring large forces for inserting and fitting a connecting object even if a great number of the contacts are arranged in the connector, and which further achieves extremely narrow pitches of the contacts, a reduced overall height of the connector, and a miniaturization of the connector particularly in the inserting direction of the connecting object.

The object is accomplished by the contact 20 according to the invention having at least one contact portion 22 adapted to contact a first connecting object and a connection portion 36 to be connected to a second connecting object, said contact 20 is provided with an protruded contact portion 24 positioned between said contact portion 22 provided at a free end of said contact and said connection portion 36 and curved and substantially aligned with said contact portion 22.

The invention lies in the contact constructed in that a member 15 having a pushing portion 26 for pushing said first connecting object is so arranged that said pushing portion 26 is in a position facing to said protruded contact portion 24.

The invention lies in the contact °constructed in that a member 15 having a pushing portion 26 for pushing said first connecting object is so arranged that said pushing portion 26 is in a position facing to said protruded contact portion 24 , and when said first connecting object is pushed by said pushing portion 26, said protruded contact portion 24 is pushed by said first connecting object in its pushed direction, as a result of which said contact portion 22 is pushed against said first connecting object owing to an action of said protruded contact portion 24 as a fulcrum.

The invention lies in the contact 20 constructed in that a member 15 having a pushing portion 26 for pushing said first connecting object is formed integrally with said contact 20 so that said pushing portion 26 is facing to said protruded contact portion 24, and the tip of said pushing portion 26 is extended and its extended end is provided at a position facing to said contact portion 22 with a second contact portion 28 adapted to contact said first connecting object.

The invention lies in the contact 20 constructed in that a member 15 having a pushing portion 26 for pushing said first connecting object is so arranged that said pushing portion 26 is in a position facing to said protruded contact portion 24, and said member 15 is formed with a slit 27 on the side of said pushing portion 26 opposite from said first connecting object so that said pushing portion 26 becomes an independent elastic piece.

The invention lies in the contact 20 comprising a first piece 30 having at one end said contact portion 22 and at the other end said connection portion 36; a second piece 32 having at one end a second contact portion 28 adapted to contact said first connecting object and a pushing portion 26 in a position facing to said protruded contact portion 24 between said second contact portion 28 and the other end for pushing said first connecting object; and an elastic jointing portion 38 for connecting said other end of the second piece 32 and the substantially mid portion of said first piece 30.

The invention lies in the contact 20 comprising a first piece 30 having at one end said contact portion 22 and at the other end said connection portion 36; a second piece 32 having at one end a second contact portion 28 adapted to contact said first connecting object, at the other end a pressure receiving portion 40, and a pushing portion 26 in a position facing to said protruded contact portion 24 between said second contact portion 28 and said other end for pushing said first connecting object; and an elastic jointing portion 38 for connecting substantially mid portions of said first and second pieces 30 and 32.

The invention lies in the contact 20 constructed in that a member 15 having a pushing portion 26 for pushing said first connecting object is so arranged that said pushing portion 26 is in a position facing to said protruded contact portion 24, and said pushing portion 26 is used as a contact portion adapted to contact said first connecting object as well.

The invention lies in the connector 10 using said contacts 20 which are arranged and held in an insulator 12.

The invention lies in the connector 10 constructed in that a pivoting member 14 is mounted on said insulator 12, said pivoting member 14 having second pushing portions 52 pivotally moving between said pressure receiving portions 40 and said connection portions 36 so that said pressure receiving portions 40 are pushed.

The invention lies in the connector 101 including contacts 201 each having at least one contact portion 221 adapted to contact a first connecting object and a connection portion 361 to be connected to a second connecting object, and an insulator 12 for arranging and holding said contacts 201, constructed in that said contacts 201 each comprise an protrude contact portion 24 positioned between said contact portion 221 provided at a free end of said contact portion 201 and said connection portion 361 and curved and substantially aligned with said contact portion 221, and a pushing portion 261 located in a fitting opening 18 of said insulator 121 so as to face to said protruded contact portion 24 of the contact 201.

The invention lies in the connector 101 constructed in that when said first connecting object is pushed by said pushing portion 261 , said protruded contact portion 24 is pushed by said first connecting object in its pushed direction, as a result of which said contact portion 221 is pushed against said first connecting object owing to an action of said protruded contact portion 24 as a fulcrum.

The invention lies in the connector 102 including contacts 202 each having at least one contact portion 222 adapted to contact a first connecting object and a connection portion 362 to be connected to a second connecting object, an insulator 122 for arranging and holding said contacts 202, and a pivoting member 142 pivotally movably mounted on said insulator 122 on the side of its fitting opening 18, constructed in that said contacts 202 each comprise an protruded contact portion 24 positioned between said contact portion 222 provided at a free end of said contact 202 and said connection portion 362 and curved and substantially aligned with said contact portion 222, and said contacts 202 each have at one end an engaging portion 58 adapted to engage said pivoting member 142 to permit the pivotal movement of the pivoting member 142 and at the other end an elastic jointing portion 382 connected to the proximity of said connection portion 362, and that said pivoting member 142 comprises anchoring holes 542 adapted to engage the engaging portions 58 of said contacts 202, and pushing portions 262 at locations facing to the protruded contact portions 24 of said contacts 202.

The invention lies in the connector 102 constructed in that when said first connecting object is pushed by said pushing portion 262, said protruded contact portion 24 is pushed by said first connecting object in its pushed direction, as a result of which said contact portion 222 is pushed against said first connecting object owing to an action of said protruded contact portion 24 as a fulcrum.

As can be seen from the explanations described above, the contact 20 and the connector 10 using the contacts 20 can bring about the following significant functions and effects.

(1) The contact according to the invention can realize a connector using the contacts which enable a connecting object to be inserted the connector with a slight inserting force even if a great number of the contacts are arranged in the connector to ensure sufficient connection stability without any deformation of the contacts. Moreover, the contact according to the invention enables a connector using the contacts to achieve an arrangement of the contacts with extremely narrow pitches in the connector, and to achieve a reduced overall height of the connector and a miniaturization of the connector particularly in the inserting direction of the connecting object.

(2) The contact according to the invention can provide a connector using the contacts which enable a connecting object to be inserted into the connector with a slight inserting force even if a great number of the contacts are arranged in the connector to ensure sufficient connection stability without any deformation of the contacts. Moreover, the contact according to the invention enables a connector using the contacts to achieve an arrangement of the contacts with extremely narrow pitches in the connector, and to achieve a reduced overall height of the connector and a miniaturization of the connector particularly in the inserting direction of the connecting object.

(3) The contact according to the invention can provide a connector using the contacts which enable a connecting object to be inserted into the connector with a slight inserting force even if a great number of the contacts are arranged in the connector to ensure sufficient connection stability without any deformation of the contacts. Moreover, the contact according to the invention realizes a connector using the contacts to achieve an arrangement of the contacts with extremely narrow pitches in the connector, and to achieve a reduced overall height of the connector and a miniaturization of the connector particularly in the inserting direction of the connecting object.

(4) The contact according to the invention can provide a connector using the contacts which enable a connecting object to be inserted into the connector with a slight inserting force even if a great number of the contacts are arranged in the connector to ensure more sufficient connection stability without any deformation of the contacts. Moreover, the contact according to the invention enables a connector using the contacts to achieve an arrangement of the contacts with extremely narrow pitches in the connector, and to achieve a reduced overall height of the connector and a miniaturization of the connector particularly in the inserting direction of the connecting object.

(5) The contact according to the invention can provide a connector using the contacts which enable a connecting object to be inserted into the connector with a slight inserting force even if a great number of the contacts are arranged in the connector to ensure more sufficient connection stability without any deformation of the contacts with the aid of the elasticity of the pushing portion 26. Moreover, as the pushing portion 26 is elastic, the contact according to the invention accomplishes more reliable connection stability and enables a connector using the contacts to achieve an arrangement of the contacts with extremely narrow pitches in the connector, and to achieve a reduced overall height of the connector and a miniaturization of the connector particularly in the inserting direction of the connecting object.

(6) The contact according to the invention can provide a connector using the contacts which enable a connecting object to be inserted into the connector with a slight inserting force even if a great number of the contacts are arranged in the connector to ensure more sufficient connection stability without any deformation of the contacts. Moreover, the contact according to the invention enables a connector using the contacts to achieve an arrangement of the contacts with extremely narrow pitches in the connector, and to achieve a reduced overall height of the connector and a miniaturization of the connector particularly in the inserting direction of the connecting object.

(7) The contact according to the invention can provide a connector using the contacts which enable a connecting object to be inserted into the connector with a slight inserting force even if a great number of the contacts are arranged in the connector to ensure sufficient connection stability without any deformation of the contacts. Moreover, the contact according to the invention enables a connector using the contacts to achieve an arrangement of the contacts with extremely narrow pitches in the connector, and to achieve a reduced overall height of the connector and a miniaturization of the connector particularly in the inserting direction of the connecting object.

(8) The contact according to the invention can provide a connector using the contacts which enable a connecting object to be inserted into the connector with a slight inserting force even if a great number of the contacts are arranged in the connector to ensure more sufficient connection stability without any deformation of the contacts. Moreover, the contact according to the invention enables a connector using the contacts to achieve an arrangement of the contacts with extremely narrow pitches in the connector, and to achieve a reduced overall height of the connector and a miniaturization of the connector particularly in the inserting direction of the connecting object.

(9) The connector according to the invention enables a connecting object to be inserted into the connector with a slight inserting force even if a great number of the contacts are arranged in the connector to ensure sufficient connection stability without any deformation of the contacts. Moreover, the connector according to the invention achieves an arrangement of the contacts with extremely narrow pitches in the connector, and achieves a reduced overall height of the connector and a miniaturization of the connector particularly in the inserting direction of the connecting object.

(10) The connector according to the invention enables a connecting object to be inserted into the connector with a slight inserting force even if a great number of the contacts are arranged in the connector to ensure more sufficient connection stability without any deformation of the contacts by merely pivotally moving the pivoting member 14. Moreover, the connector according to the invention achieves an arrangement of the contacts with extremely narrow pitches in the connector, and achieves a reduced overall height of the connector and a miniaturization of the connector particularly in the inserting direction of the connecting object.

(11) The connector according to the invention enables a connecting object to be inserted into the connector with a slight inserting force even if a great number of the contacts are arranged in the connector to ensure more sufficient connection stability without any deformation of the contacts by merely pivotally moving the pivoting member 14. Moreover, the connector according to the invention achieves an arrangement of the contacts with extremely narrow pitches in the connector, and achieves a reduced overall height of the connector and a miniaturization of the connector particularly in the inserting direction of the connecting object.

(12) The connector according to the invention enables a connecting object to be inserted into the connector with a slight inserting force even if a great number of the contacts are arranged in the connector to ensure more sufficient connection stability without any deformation of the contacts by merely pivotally moving the pivoting member 14. Moreover, the connector according to the invention achieves an arrangement of the contacts with extremely narrow pitches in the connector, and achieves a reduced overall height of the connector and a miniaturization of the connector particularly in the inserting direction of the connecting object.

(13) The connector according to the invention enables a connecting object to be inserted into the connector with a slight inserting force even if a great number of the contacts are arranged in the connector to ensure more sufficient connection stability without any deformation of the contacts by merely pivotally moving the pivoting member 14. Moreover, the connector according to the invention achieves an arrangement of the contacts with extremely narrow pitches in the connector, and achieves a reduced overall height of the connector and a miniaturization of the connector particularly in the inserting direction of the connecting object.

(14) The connector according to the invention enables a connecting object to be inserted into the connector with a slight inserting force even if a great number of the contacts are arranged in the connector to ensure more sufficient connection stability without any deformation of the contacts by merely pivotally moving the pivoting member 14. Moreover, the connector according to the invention achieves an arrangement of the contacts with extremely narrow pitches in the connector, and achieves a reduced overall height of the connector and a miniaturization of the connector particularly in the inserting direction of the connecting object.

The invention will be more fully understood by referring to the following detailed specification and claims taken in connection with the appended drawings.

DESCRIPTION OF THE PREFERRED EMBODIMENTS

The subject feature of the invention lies in the contact having at least one contact portion adapted to contact a first connecting object and a connection portion to be connected to a second connecting object, the contact comprising an protruded contact portion which is positioned between the contact portion provided at a free end of the contact and the connection portion and curved and substantially aligned with the contact portion, and further comprising a member having a pushing portion located in a position facing to the protruded contact portion for pushing the first connecting object.

Namely, when the first connecting object is pushed by the pushing portion, the protruded contact portion is pushed by the pushed first connecting object downwardly (in the pushing direction), with the result that the protruded contact portion defines a fulcrum to cause the contact portion to be pushed to the first connecting object.

There are three configurations for carrying out the invention. The first configuration is a so-called rear lock type in which a pivoting member is mounted on a housing on the side opposite from a fitting opening into which a first connecting object is inserted. The second configuration is a so-called non-zero insertion force (N-ZIF) type or low insertion force (LIF) type in which by merely inserting a connecting object, it comes immediately into contact with contacts. The third configuration is a so-called front lock type in which a pivoting member is mounted on the side of a fitting opening of an insulator into which a first connecting object is inserted.

Figure 1A:
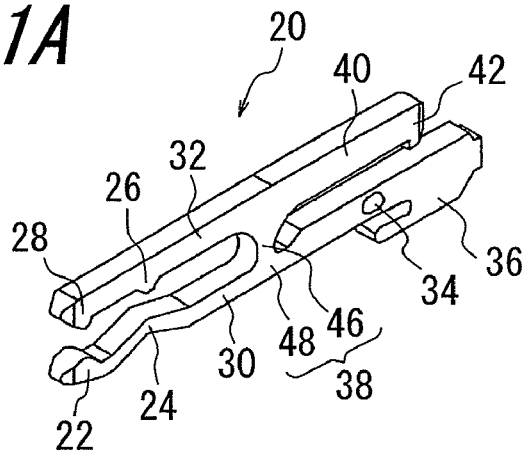
FIG. 1A is a perspective view of the contact according to the invention.
Figure 1B:
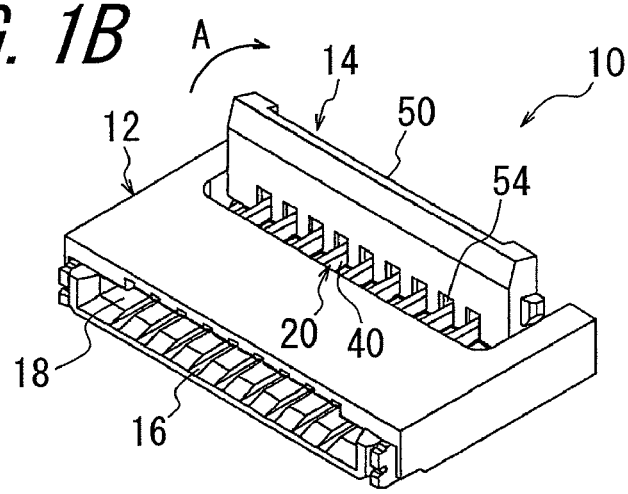
FIG. 1B is a perspective view of a connector using the contacts shown in FIG. 1A.
Figure 1C:
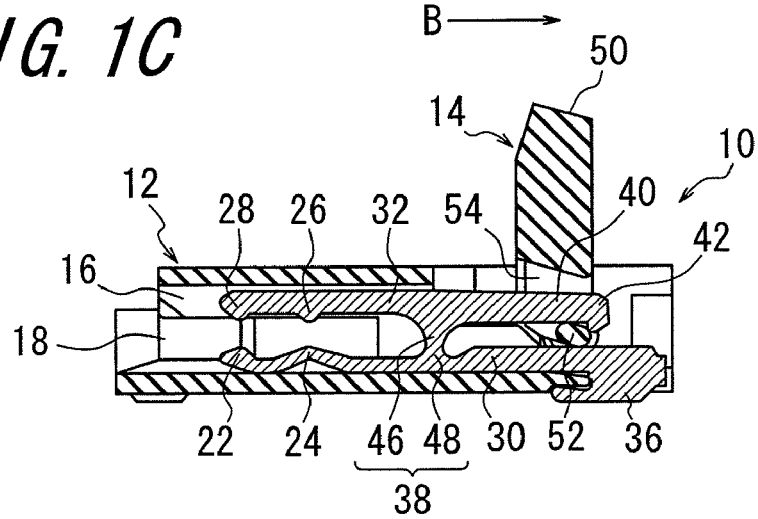
FIG. 1C is a sectional view of the connector shown in FIG. 1B, taken along one contact.
Figure 2:
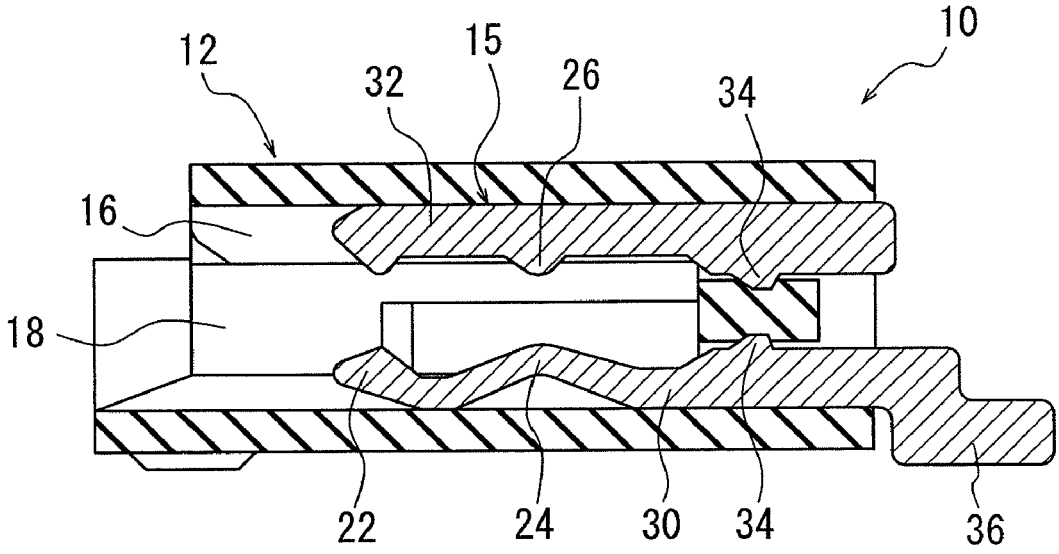
FIG. 2 is a sectional view of a connector using members and contacts according to the invention, taken along one contact.
Figure 3A:
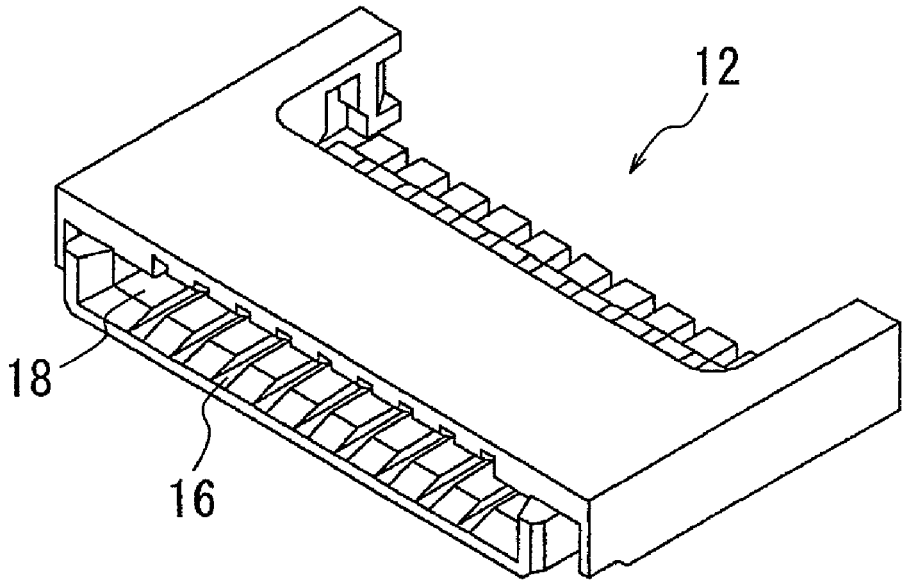
FIG. 3A is a perspective view of an insulator viewed from the above on the side of its fitting opening.
Figure 3B:
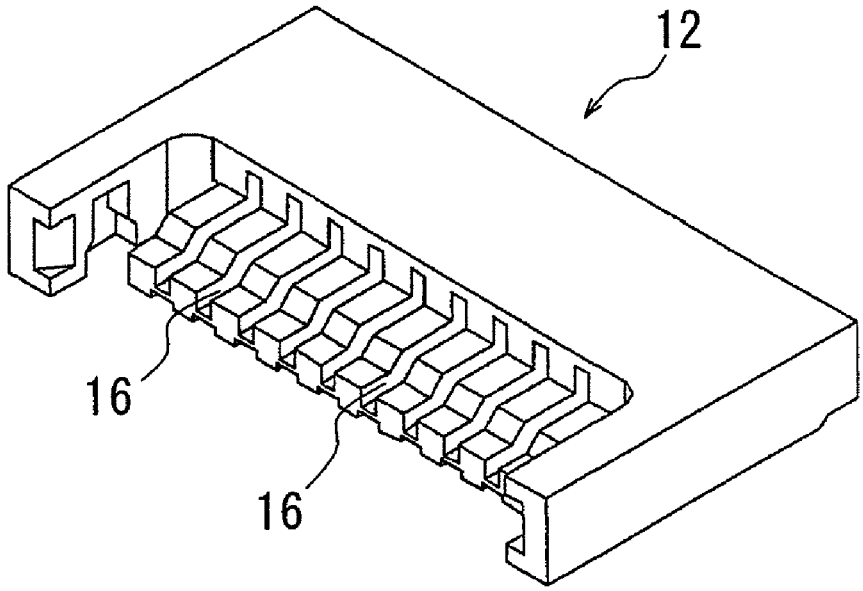
FIG. 3B is a perspective view of the insulator viewed from the above on the side of its connection side.
Figure 4A:
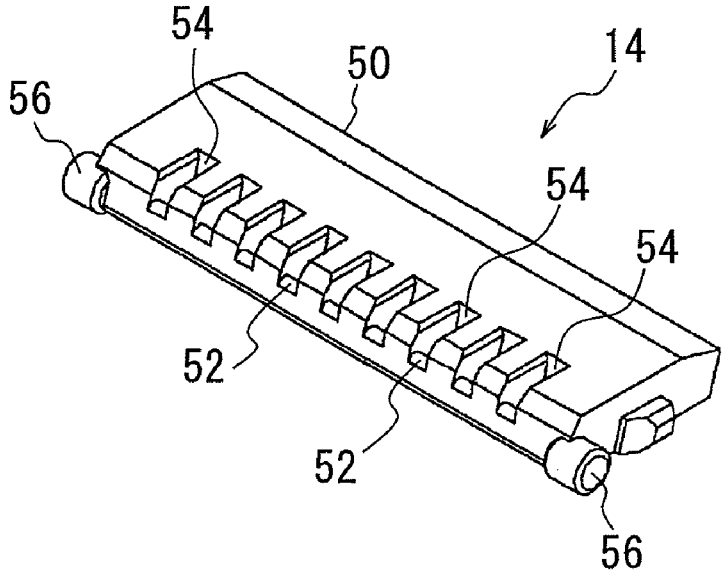
FIG. 4A is a perspective view of a pivoting member viewed from the side of its anchoring holes.
Figure 4B:
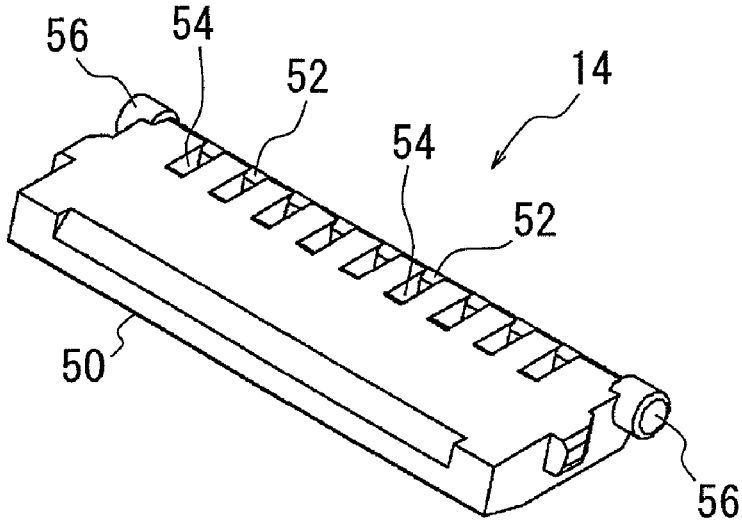
FIG. 4B is a perspective view of the pivoting member viewed from the side of its actuating portion.
Figure 5:
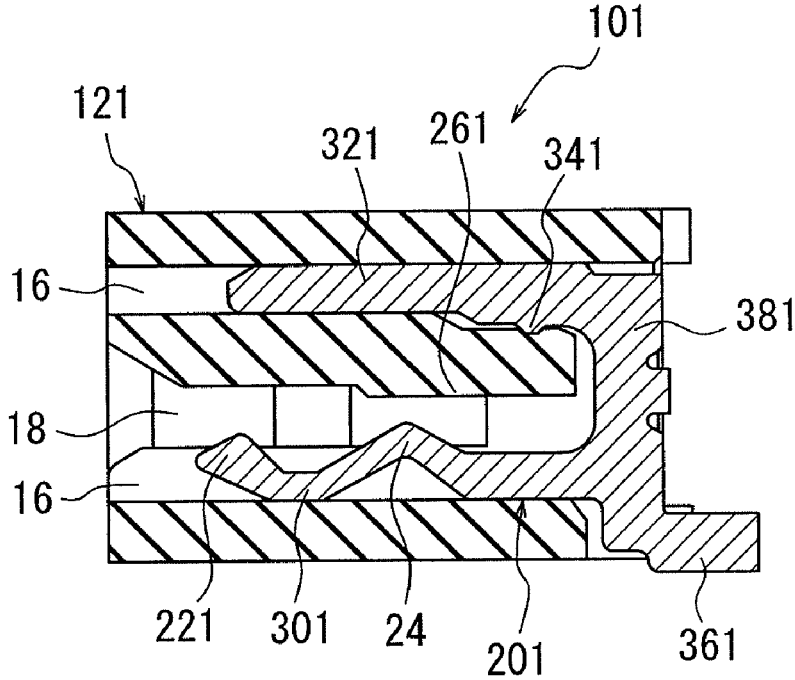
FIG. 5 is a sectional view of a connector of a non-zero insertion force type according to the invention, taken along one contact.
Figure 6:
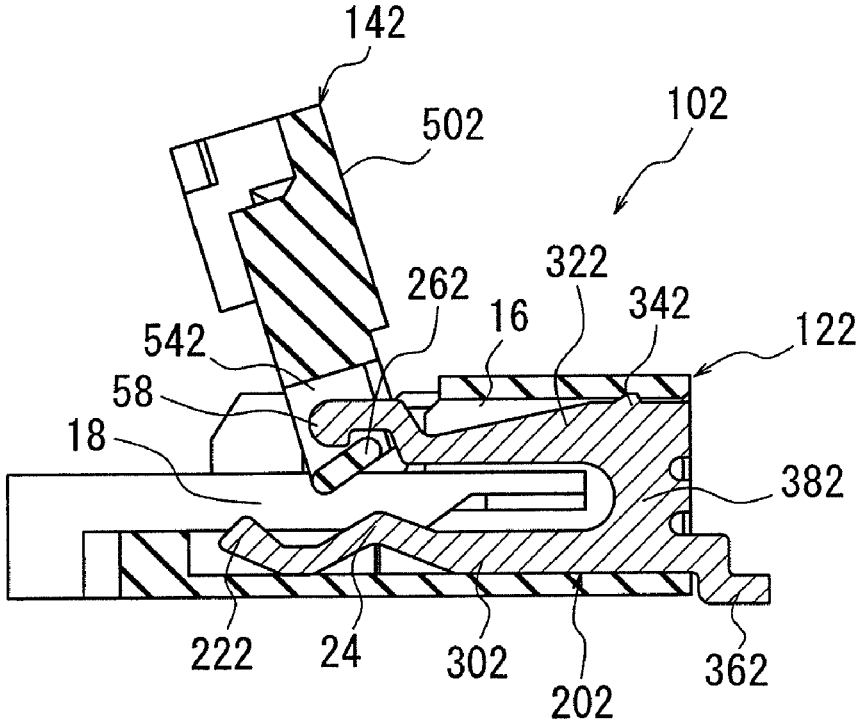
FIG. 6 is a connector of a front lock type according to the invention, taken along one contact.
Figure 7:
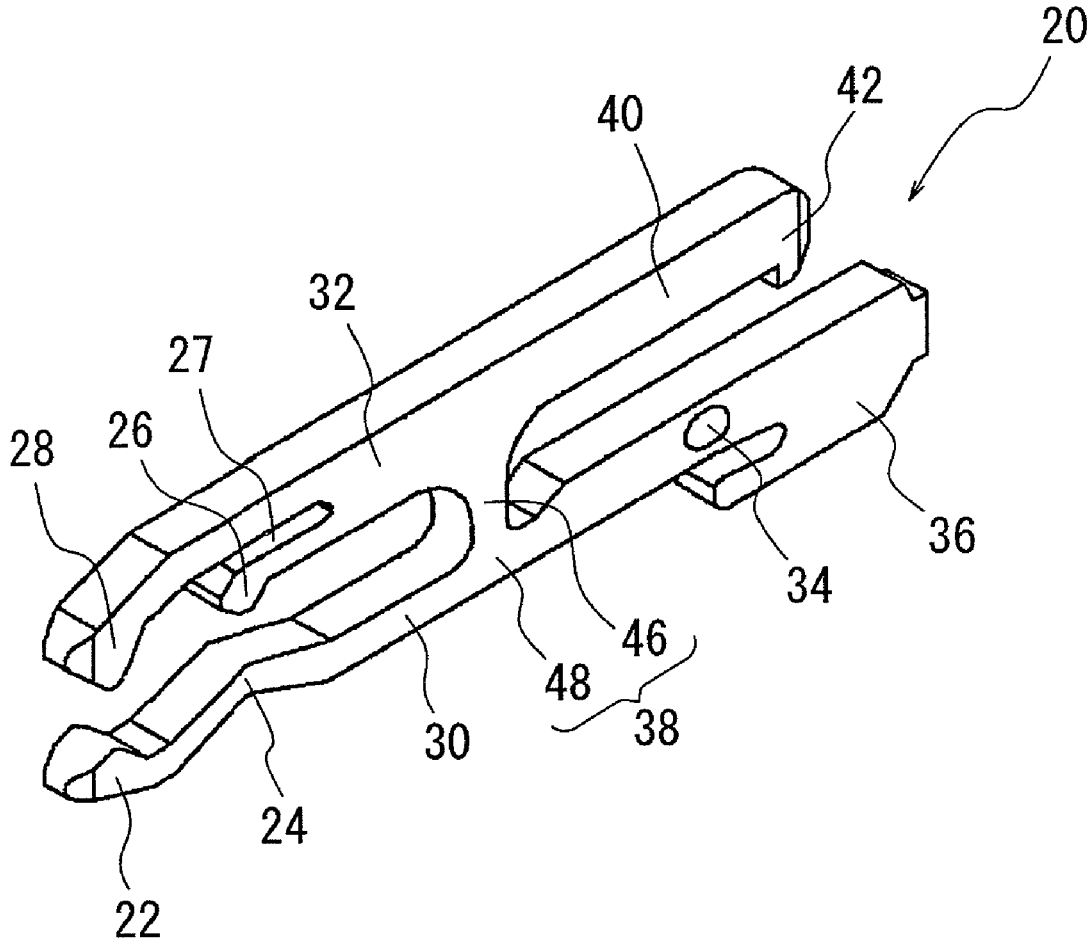
FIG. 7 is a perspective view of a contact constructed by forming a slit in a contact similar to that shown in FIG. 1A.

First, contacts 20 according to the invention and a connector 10 of the rear lock type using the contacts 20 will be explained with reference to FIGS. 1A to 1C, FIGS. 3A and 3B, and FIGS. 4A and 4B. FIG. 1A is a perspective view of the contact according to the invention, while FIG. 1B is a perspective view of the connector using the contacts shown in FIG. 1A and FIG. 1C is a sectional view of the connector shown in FIG. 1B, taken along one contact. FIG. 2 is a sectional view of a connector using members and contacts, taken along one contact. FIG. 3A is a perspective view of an insulator viewed from the above of the fitting opening, and FIG. 3B is a perspective view of the insulator viewed from the above of the connection side. FIG. 4A is a perspective view of a pivoting member viewed from the side of its anchoring holes, while FIG. 4B is a perspective view of the pivoting member viewed from the side of its actuating portion. FIG. 5 is a sectional view of a connector of the non-zero insertion (N-ZIF) type, taken along one contact. FIG. 6 is a sectional view of a connector of the front lock type, taken along one contact. FIG. 7 is a perspective view of a contact constructed by forming a slit in a contact similar to the contact shown in FIG. 1A.

At the beginning, the contacts 20 according to the invention will be explained. The contacts 20 are made of a metal and formed by means of the press-working of the known technique. Preferred metals from which to form the contacts 20 include brass, beryllium copper, phosphor bronze and the like which comply with the requirements as to springiness, electric conductivity, and the like. The contact 20 in the embodiment is substantially H-shaped as shown in FIG. 1A, and comprises at least a first piece 30 having at one end as a free end a contact portion 22 adapted to contact a first contacting object and at the other end a connection portion 36 to be connected to a second connecting object, an protruded contact portion 24 positioned on the first piece 30 between the contact portion 22 and the connection portion 36 and curved and substantially aligned with said contact portion 22, a second piece 32 having at one end as a free end a second contact portion 28 adapted to contact the first contacting object and at the other end a pressure receiving portion 40, a pushing portion 26 located at a position facing to the protruded contact portion 24 for pushing said first contacting object, and an elastic jointing portion 38 (including an elastic portion 46 and a fulcrum portion 48 in this case) for connecting said first piece 30 and said second piece 32. The respective parts of the contact will be explained hereinafter.

First, the contact portion 22 will be explained. The contact portion 22 is provided at the one end as the free end of said first peace 30 and adapted to contact said first connecting object (a flexible printed circuit board 70 in this case). As said first connecting object, there may be a mating connector, the flexible printed circuit board 70, flexible flat cable, or the like. Said contact portion 22 may be suitably designed so as to match a contacting object in consideration of contact stability, contact pressure, inserting force, deformation of the contact 20, and the like. The contact portion 20 is in the form of a protrusion in the illustrated embodiment.

The protruded contact portion 24 will then be explained. The protruded contact portion 24 is provided on said first peace 30 between said contact portion 22 and said connection portion 36 and positioned substantially aligned with said contact portion 22. Said protruded contact portion 24 is curved so as to extend onto the side of the flexible printed circuit board inserted thereinto because the protruded contact portion 24 has to contact the inserted circuit board and has to perform the following functions.

The second contact portion 28 will then be explained. The second contact portion 28 is provided at the one end as the free end of the second piece 32 and adapted to contact the first connecting object (the flexible printed circuit board 70 in this case). Said second contact portion 28 may be suitably designed so as to match the contacting object taking into account contact stability, contact pressure, inserting force, deformation of the contact 20, and the like. The second contact portion 28 is in the form of a protrusion in the illustrated embodiment.

The pushing portion 26 will then be explained. Said pushing portion 26 is located in the position facing to said protruded contact portion 24 and serves to push the first connecting object and to perform the following functions. Therefore, the pushing portion 26 is in the form of a protrusion extending toward the inserted flexible printed circuit board 70. Moreover, said pushing portion 26 may also be used as a contact portion simultaneously.

At this moment, operations of the protruded contact portion 24 and the pushing portion 26 will be explained. After the flexible printed circuit board 70 has been inserted, when said circuit board 70 is pushed by the pushing portion 26, said protruded contact portion 24 is pushed downwardly by the circuit board 70 (into the pushing direction of the circuit board), with the result that said protruded contact portion 24 itself defines a fulcrum to cause said contact portion 22 to be pushed against the circuit board 70. In other words, the contact portion 22 is pushed against the circuit board 70 owing to an action of the protruded contact portion 24 as a fulcrum. The shapes and sizes of said protruded contact portion 24 and said pushing portion 26 may be suitably designed in consideration of these functions, contact stability, workability, miniaturization of the connector 10, and the like.

In order to ensure such a function of the pushing portion 26, the contact is preferably formed with a slit 27 on the rear side of the pushing portion 26 (on the side of the pushing portion 26 opposite from the inserted first connecting object), whereby the pushing portion 26 becomes an independent elastic piece as shown in FIG. 7.

Said first piece 30 and said second piece 32 are connected to each other substantially at their mid portions by said elastic jointing portion 38 (including the elastic portion 46 and the fulcrum portion 48). Said elastic jointing portion 38 (including the elastic portion 46 and the fulcrum portion 48) and said pressure receiving portion 40 provided at the other end of the second piece 32 serve to perform the following functions. After said flexible printed circuit board 70 has been inserted into the fitting opening 18 of the insulator 12, when second pushing portions 52 of the pivoting member 14 are pivotally moved between the connection portions 36 and the pressure receiving portions 40 of said contacts 20, the pressure receiving portions 40 are raised by said second pushing portions 52, with the result that the elastic portions 46 of said contacts 20 are tilted toward the pushing portions 26 of said second pieces 32 about the fulcrum portions 48 of said contacts 20, thereby enabling said pushing portions 26 and the second contact portions 28 to be pushed against said circuit board 70. Sizes and shapes of said fulcrums 48, said elastic portions 46, and said pressure receiving portions 40 may be suitably designed so as to achieve such functions.

The functions of said protruded contact portion 24, said pushing portion 26, said pressure receiving portion 40, and said elastic jointing portion 38 (including said elastic portion 46 and said fulcrum portion 48) are wholly summarized as follows. After said flexible printed circuit board 70 has been inserted into the fitting opening 18 of the insulator 12, when second pushing portions 52 of the pivoting member 14 are pivotally moved between the connection portions 36 and the pressure receiving portions 40 of said contacts 20, the pressure receiving portions 40 are raised by said second pushing portions 52, with the result that the elastic portions 46 of said contacts 20 are tilted toward the pushing portions 26 of said second pieces 32 about the fulcrum portions 48 of said contacts 20. As a result, said circuit board 70 is pushed by said pushing portions 26 and further said protruded contact portions 24 are pushed downwardly (in the pushing direction) by the pushed circuit board 70 so that the downwardly pushed protruded contact portions 24 define fulcrums, respectively, to cause said contact portions 22 to be pushed to said circuit board 70.

The fixed portion 34 will then be explained. The fixed portion 34 is held in the insulator 12 by press-fitting in the illustrated embodiment. In more detail, the fixed portion 34 is fixed in the insulator 12 with interferences in width directions of the fixed portion 34.

The connection portion 36 will be finally explained. Said connection portion 36 is to be connected to the second connecting object which may be a substrate 80, flexible printed circuit board, flexible flat cable, or the like. The connection portion 36 may be suitably designed so as to mach the object to be connected. As the connection portion 36 is connected to the substrate 80 in the illustrated embodiment, the connection portion 36 is of a surface mounting type (SMT) in consideration of ability for mounting the conductors, occupied area, high density of the conductors, and the like. In the case of a flexible flat cable, the connection portion 30 is suitably designed in consideration of the same factors as in the case of the substrate and the flexible printed circuit board.

The insulator 12 will then be explained. The insulator 12 is formed from an electrically insulating plastic material by means of the injection molding of the known technique. The materials for the insulator 12 may be suitably selected in consideration of dimensional stability, workability, manufacturing cost, and the like, and generally include polybutylene terephthalate (PBT), polyamide (66PA, 46PA, or PA9T), liquid crystal polymer (LCP), polycarbonate (PC), polyphenylene sulfide (PPS), and the like and combination thereof.

Said insulator 12 is formed with inserting holes 16 for installing a required number of the contacts therein, respectively, which are fixed in the respective inserting holes 16 by press-fitting, hooking (lancing), welding or the like. Said inserting holes 16 need only be able to receive the contacts 20 and may be suitably designed taking into account holding force, strength, workability, and the like.

Moreover, said insulator 12 is provided with the fitting opening 18 into which the flexible printed circuit board 70 is inserted. The fitting opening 18 need only be able to receive the circuit board 70 and may be suitably designed in consideration of the size of the flexible printed circuit board 70, contact pressure with the contacts 20, connection stability, and the like.

The pivoting member 14 will then be explained. The pivoting member 14 is formed from an electrically insulating plastic material by means of the injection molding of the known technique. The materials for the pivoting member 14 may be suitably selected in consideration of dimensional stability, workability, manufacturing cost, and the like, and generally include polybutylene terephthalate (PBT), polyamide (66PA or 46PA), liquid crystal polymer (LCP), polycarbonate (PC), polyphenylene sulfide (PPS), and the like and combination thereof.

The pivoting member 14 mainly comprises an actuating portion 50, axles 56 adapted to be fitted in the insulator 12 for pivotably mounting the pivoting member 14 on the insulator 12, second pushing portions 52 for pushing the pressure receiving portions 40 of said contacts 20, and anchoring holes 54 adapted to engage extended portions 42 of said contacts 20. Said axles 56 are fulcrums for pivotal movements of said pivoting member 14 and suitably fitted in the longitudinal ends of said insulator 12 to permit the pivoting member 14 to be pivotally moved. The pivoting member 14 is further provided at longitudinal ends with locking portions adapted to engage the insulator 12 for preventing the pivoting member 16 from being lifted (in the upward direction in the drawing) when the pressure receiving portions 40 of said contacts 20 are pushed by the second pushing portions 52 of the pivoting member 14. Shapes and sizes of the locking portions need only be able to engage said insulator 12 and may be suitably designed in consideration of the functions described above, the size and strength of the connector 10, and the like.

Said second pushing portions 52 serve to push the pressure receiving portions 40 of said contacts 20 and their shape is preferably an elongated shape, particularly elliptical in the illustrated embodiment. With such an elliptical shape, when the pivoting member 14 is pivotally moved in the direction shown by an arrow A in FIG. 1B so as to rotate its second pushing portions 52 in the space between the pressure receiving portions 40 and the connection portions 36 of said contacts 20, the pressure receiving portions 40 of said contacts 20 are moved upwardly with the aid of variation in contacting height owing to the elliptical shape of the second pushing portions 52, thereby pushing the contact portions 22 of said contacts 20 against flexible printed circuit board 70. The second pushing portions 52 may be formed in any shape insofar as they can rotate between the pressure receiving portions 40 and the connection portions 36 of said contacts 20, and the pressure receiving portions 40 of said contacts 20 can be raised with the aid of the variation in contacting height owing to, for example, difference in major and minor axes of an ellipse.

The pivoting member 16 is further provided with anchoring holes 54 independent from one another, which are adapted to engage extended portions 42 of said contacts 20 for the purpose of preventing the pivoting member 14 from being deformed at the middle in a direction shown by an arrow B in FIG. 1C. The anchoring holes 54 provided independently from one another serve to maintain the strength of the pivoting member 14 and to prevent it from being deformed when pivotally moving.

At this moment, a member 15 formed as a separate part of the pushing portion 26 for the so-called non-zero insertion force type, and a contact 20 will be explained with reference to FIG. 2. The member 15 and the contact 2 are substantially I-shaped as shown in FIG. 2. The member 15 is made of a metal and formed by means of the press-working of the known technique. Preferred metals from which to form said member 15 include brass, beryllium copper, phosphor bronze and the like which comply with the requirements as to springiness, electric conductivity, and the like. The metals for the contacts are similar to those described above. Operations of said pushing portion 26 and protruded contact portion 24 are similar to those described above, and different features only will be described.

A fundamental difference lies in the feature of forming the part having the pushing portion 26 as a separate part of the contact. As said pushing portions 26 extend into the fitting opening 18, when the flexible printed circuit board 70 is inserted into the fitting opening 18, the circuit board 70 is consequently pushed by the pushing portions 26. Upon the circuit board 70 being pushed, the protruded contact portions 24 of the contacts 20 are pushed downwardly by the pushed circuit board 70 so that the functions described above are performed. The distances to which the pushing portions 26 extend into the fitting opening 18 may be suitably designed in consideration of such functions, connection stability, contacting property when the pushing portions 26 are used as contact portions, and the like.

Now, a so-called non-zero insertion force type connector 101 will be explained with reference to FIG. 5. The connector 101 comprises at least an insulator 121 and contacts 201. The materials of the insulator 121 and the contacts 201 are similar to those described above.

The contact 201 is substantially U-shaped and comprises at least a first piece 301 having at one end as a free end a contact portion 221 adapted to contact a first connecting object and at the other end a connection portion 361 to be connected to a second connecting object, an protruded contact portion 24 positioned on the first piece 301 between the contact portion 221 and the connection portion 361 and curved and substantially aligned with said contact portion 221, a second piece 321 having one end as a fixed end to be inserted in the insulator 121 and a fixed portion 341 in the proximity of the other end to be fixed to the insulator 121, and an elastic jointing portion 381 for connecting proximities of the connection portion 361 of said first piece 301 and of the fixed portion 341 of said second piece 321. The contact portion 221, the protruded contact portion 24, the connection portion 361, and the fixed portion 341 are similar to those described above. The elastic jointing portion 381 serves only to joint the first piece 301 and the second piece 321 as is not the case with the elastic jointing portion previously described.

The insulator 121 has a plurality of inserting holes 16 into which contacts 201 are inserted, respectively, which is similar to the insulator 12. A different feature is to provide in the insulator 121 with pushing portions 261 located in the fitting opening 18 at positions facing to the protruded contact portions 24 of said contacts 201. The pushing portions 261 also perform the same functions described above.

A connector 102 of a so-called front lock type will then be explained with reference to FIG. 6. The connector 102 comprises at least an insulator 122, contacts 202, and a pivoting member 142. Materials of the insulator 121, the contacts 202, and the pivoting member 142 are similar to those described above.

The contact 202 is substantially U-shaped and comprises at least a first piece 302 having at one end as a free end a contact portion 222 adapted to contact a first connecting object and at the other end a connection portion 362 to be connected to a second connecting object, an protruded contact portion 24 positioned on the first piece 302 between the contact portion 222 and the connection portion 362 and curved and substantially aligned with said contact portion 222, a second piece 322 having one end as a free end an engaging portion 58 adapted to engage an anchoring hole 542 of the pivoting member 142 and at the other end a fixed portion 342 to be fixed to the insulator 122, and an elastic jointing portion 382 for connecting proximities of the connection portion 362 of said first piece 302 and of the fixed portion 342 of said second piece 322. The contact portion 222, the protruded contact portion 24, the connection portion 362, and the fixed portion 342 are similar to those described above. The elastic jointing portion 382 serves only to joint the first piece 302 and the second piece 322, which is different from the elastic jointing portion 38 described above. The shape and size of said engaging portion 58 may be suitably designed to make it possible to pivotally move the pivoting member 142 and to push the flexible printed circuit board 70 by the pushing portions 262 of the pivoting member 142.

The insulator 122 has also a plurality of inserting holes 16 into which the contacts 202 are inserted, respectively, as is also the case of the insulator 12 described above. There is no particular difference between these insulators.

The pivoting member 142 mainly comprises an actuating portion 502, axles for pivotally mounting the pivoting member 142 on the insulator 122, anchoring holes 542 adapted to engage the engaging portions 58 of said contacts 202, and pushing portions 262 for pushing the flexible printed circuit board 70. Said axles are fulcrums for the pivotal movement of said pivoting member 142 and suitably fitted in the longitudinal ends of said insulator 122 to permit the pivoting member 142 to be pivotally moved. Said pushing portions 262 serve to push the circuit board 70 and are preferably of an elongated shape, particularly elliptical in the illustrated embodiment. With such an elliptical shape, when the pivoting member 142 is pivotally moved, the flexible printed circuit board 70 is pushed toward the contact portions 222 of said contacts 202 with the aid of variation in contact height owing to the elliptical shape of the pushing portions 262. Moreover, the pivoting member 142 is provided with anchoring holes 542 independent from one another, which are adapted to engage the engaging portions 58 of said contacts 202. The anchoring holes 542 provided independently from one another serve to maintain the strength of the pivoting member 142 and to prevent it from being deformed when pivotally moving.

Examples of applications are connectors for use with electric and electronic appliances such as office automation appliances, factory automation appliances, cellular or mobile phones, and the like, and particularly contacts for use in connectors which are superior in connection stability and reduced overall height of the connectors.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A contact having at least one contact portion provided at a free end of a first piece and adapted to contact a first connecting object and a connection portion to be connected to a second connecting object, wherein said contact is provided with a protruded contact portion positioned between said contact portion and said connection portion and curved and substantially aligned with said contact portion, wherein a member having a pushing portion for pushing said first connecting object is arranged so that said pushing portion is in a position facing to said protruded contact portion, and wherein, when said first connecting object is pushed by said pushing portion, said protruded contact portion is pushed by said first connecting object in its pushed direction, as a result of which said contact portion is pushed against said first connecting object owing to an action of said protruded contact portion as a fulcrum.

2. A connector using said contactas claimed in claim 1.

* * * * *